United States Patent [19]

Sternberger et al.

[11] Patent Number: 4,806,126

[45] Date of Patent: Feb. 21, 1989

[54] PROCESS FOR ALKALI-FREE DYEING AND PRINTING WITH REACTIVE DYES

[75] Inventors: Klaus Sternberger, Bad Vilbel; Karl-Heinz Keil, Hanau, both of Fed. Rep. of Germany; Dieter Gevert; Oscar Navarrete, both of Santiago, Chile

[73] Assignee: Hoechst Aktiengesellschaft, Frankfurt am Main, Fed. Rep. of Germany

[21] Appl. No.: 172,010

[22] Filed: Mar. 23, 1988

[30] Foreign Application Priority Data

Mar. 25, 1987 [DE] Fed. Rep. of Germany ..... 3709766

[51] Int. Cl.[4] ..... C09B 62/00; D06P 1/38; D06P 1/54

[52] U.S. Cl. ..... 8/543; 8/495; 8/544; 8/551; 8/630; 8/650; 8/676; 8/680; 8/918

[58] Field of Search ..... 8/543, 495, 551, 680

[56] References Cited

U.S. PATENT DOCUMENTS

| | | | |
|---|---|---|---|
| 3,301,696 | 1/1967 | Taube et al. | 8/496 |
| 3,334,138 | 8/1967 | Feeman | 8/551 |
| 4,439,203 | 3/1984 | Runyon et al. | 8/496 |
| 4,452,606 | 6/1984 | van Diest et al. | 8/496 |
| 4,511,707 | 4/1985 | Runyon et al. | 8/496 |
| 4,588,413 | 5/1986 | Keil et al. | 8/543 |

FOREIGN PATENT DOCUMENTS

| | | |
|---|---|---|
| 236896 | 9/1987 | European Pat. Off. . |
| 55-152879 | 11/1980 | Japan . |
| 2006279 | 5/1979 | United Kingdom . |

*Primary Examiner*—A. Lionel Clingman

[57] ABSTRACT

Process for alkali-free dyeing and printing with reactive dyes. Beforehand, the textile material is treated with a wetting agent and a reaction product of polyethyleneimine and a bifunctional alkylating agent. This is followed by dyeing with reactive dyes in a conventional manner but without the addition of alkali to fix the dyes.

7 Claims, No Drawings

PROCESS FOR ALKALI-FREE DYEING AND PRINTING WITH REACTIVE DYES

DESCRIPTION

Textile materials, for example woven fabrics, knitted fabrics or even yarns and filaments, which consist of or contain cellulose fibers can be dyed with reactive dyes by existing processes where the textile material is treated in the manner of an exhaust process with a dyeing liquor containing reactive dye, usually at elevated temperature and, with most commercially available reactive dye types, in the presence of alkali, or it is possible to employ continuous or batchwise processes, for example the pad-steam process or the cold pad-batch process. With both the pad-steam process and the cold pad-batch process, the textile material is first padded with a reactive dye liquor, and the alkali required for fixation is customarily applied in a separate impregnating step. In the pad-steam process, the dye is then fixed by steaming, while in the cold pad-batch process the dye is fixed by beaming the impregnated material onto a batch roller which is then left at room temperature for several hours. Other fixation techniques have also become known and are practiced in industry, for example where a textile material which has been padded with an alkali-free reactive dye liquor is treated with caustic soda/waterglass solution.

In all the reactive dyeing processes mentioned, a covalent chemical bond becomes established in the course of dyeing between the dye molecule and the cellulose molecule. This type of dye thus becomes attached to the fiber by chemical means.

Theoretically, reactive dyeings on cellulose thus should automatically have very high wet fastness levels. In reality, however, this is not found to be the case. The reasons for this vary and not all of them may as yet be known. However, it is possible to state that a certain proportion of the reactive dye used for dyeing reacts not with the cellulose fiber but with water molecules. In the reaction with water, the reactive dye loses its ability to bond chemically to the cellulose and becomes bonded to the fiber molecule by secondary valence forces only.

This phenomenon in the industrial practice of dyeings ultimately has the effect that dyeings of reactive dyes on cellulose fibers only have high wet fastness levels if, after dyeing, they are subjected to a thorough afterwash. The technical resources required for this aftertreatment are virtually of the same order as those for the actual dyeing process. In particular, the afterwash requires large quantities of water, and frequently it is necessary, if the desired high wet fastness is to be attained for the dyeings, to carry out not just one washing operation but several washing operations in succession. The complexity and the high demand made by washing operations on technical and financial resources have provided the stimulus for detailed investigations into the washoff mechanism of residual dye. As an example thereof, reference is made to the paper by Dipl.-Chem. F. Somm and Text.-Ing. (grad.) R. Buser entitled "Einfluss verschiedener Parameter auf das Auswaschverhalten von Reaktivfarbstoffen" [Influence of various parameters on the washoff behavior of reactive dyes] in Textil-Praxis International, July 1982.

Nor has there been any shortage of attempts and proposals for facilitating the washing off of dye residues and/or to enhance the wet fastness of dyeings without having to raise washoff resources.

German Laid-Open Application DOS No. 2,910,583 discloses a soaping aid for dyeings and prints on textile materials, which is based on the use of alkali metal aluminosilicate alone or combined with polyvinylpyrrolidone.

The problem of removing from the fiber inherently water-soluble portions of hydrolyzed reactive dye which, owing to their substantivity, are bonded to the cellulose fiber by secondary valence forces, and hence of improving the wet fastness levels of the dyed material, has previously also been addressed in German Laid-Open Applications DOS Nos. 2,747,358 and DOS 2,843,645. Said DOS No. 2,747,358 recommends using polyamines, polyamides or polyurethanes and even polyureas for this purpose. According to DOS No. 2,843,645, alkoxylated polyamines, for example alkoxylated polyethyleneimine, can be used for the same purpose.

To solve a similar problem, namely improving the wet fastness properties of direct dyeings, German Published Applications DAS Nos. 1,111,144 and DAS 1,131,649, Belgian Pat. No. 625,711 and U.S. Pat. No. 3,334,138 disclose the aftertreatment of the dyeings with basic polyguanidine compounds and with polymeric quaternized, nitrogen-containing compounds.

A further prior art proposal for improving the wet fastness properties of direct dyeings comprises an aftertreatment with condensation products of cyanamide, formaldehyde and salts of organic amines or ammonium salts.

Japanese Patent Application No. 53-675 concerns the aftertreatment of vat dyeings for the purpose of fastness improvement. However, the technical problem in said prior art differs fundamentally from that of the aftertreatment of reactive dyeings.

It has now been found that cellulose material can be dyed and printed with reactive dyes without using alkali, if the cellulose material is pretreated with a wetting agent and a quaternized or unquaternized reaction product of polyethyleneimine with a bifunctional alkylating agent, and then dyed with reactive dyes in a conventional manner but without alkali, and the dyeings are completed by rinsing, soaping and drying.

The assistant required for the pretreatment is known from U.S. Pat. No. 4,588,413. There the assistant is exclusively used for the aftertreatment of dyeings with reactive dyes. A pretreatment with this assistant and a subsequent dyeing without alkali is not described therein. A process exclusively for aftertreating reactive dyes with compounds of a similar structure is also described in GB Pat. No. 2,006,279.

The polyethyleneimine required for preparing the pretreatment agent to be used according to the invention conforms to the formula I $$H-(CH_2-CH_2-NH)_a-(CH_2-CH_2-\underset{\underset{X}{|}}{N})_b-H \qquad (I)$$

where

X is a radical of the formula $-(CH_2-CH_2-NH-)_c-H$, a and b are independently of each other numbers from 0 to 600, the sum a+b being a number from 50–600, and c is a number from 0 to 50.

Consequently, the polyethyleneimine used is a molecule containing $—NH_2$, >NH and —N< units which are linked to each other by ethylene groups. In total the polyethyleneimine contains about 50 to 600 ethyleneimine units. Customary commercial products contain primary, secondary and tertiary nitrogen functions in a numerical ratio of about 1:2:1.

The reaction with the ethyleneimine of the formula I can in principle be carried out with any known bifunctional alkylating agent. These known bifunctional alkylating agents conform to the formula II $$A—Z—A \quad (II)$$

In this formula, A denotes the radical of an alkylating species and Z denotes either a direct bond or a divalent bridge member.

Particular suitability for the reaction with the polyethyleneimines to give the assistants to be used according to the invention is possessed by those bifunctional alkylating agents of the formula II where A denotes a group of the formula $—CH_2—Y$ in which Y denotes a substituent which is detachable in the form of an anion, in particular chlorine or bromine, iodine or —OH, or a group which is detachable in the form of an anion, in particular a sulfato group or a sulfonyloxy group, in particular phenylsulfonyloxy or p-tolylsulfonyloxy, or an epoxy group

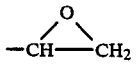

and Z, if it is not a direct bond, stands for a divalent straight-chain or branched radical of the formula III $$—C_nH_{2n}— \quad (III)$$

where n is a number from 1 to 4, for a divalent radical of the formula IV $$—C_mH_{2m}—D—C_mH_{2m}— \quad (IV)$$

where m is 1 or 2 and D is —O—, —S—, —NH—, —CO—, —SO— or $—SO_2—$, or for phenylene.

Preference for the reaction with polyethyleneimine to give assistants to be used according to the invention is given to those bifunctional alkylating agents where the As are groups of the formula $—CH_2—Y$ which are linked to each other via a bridge member of the formula IV, or to those in which one of the A radicals is a group of the formula $—CH_2—Y$ which is bonded directly to an epoxy group.

Examples of those bifunctional alkylating agents are epichlorohydrin, glycidol, 1,3-dichloro-2-propanol, β,β'-dichlorodiethyl ether, β,β'-dichlorodiethylamine, β,β'-dichlorodiethyl sulfide, β,β'-dichlorodiethyl sulfoxide, β,β'-dichlorodiethyl sulfone, β,β'-disulfatoethyl ether, β,β'-diphenylsulfonyloxyethyl ether, meta- or para-diepoxyethylbenzene, meta- or para-diepoxypropylbenzene, diepoxybutane, diepoxy-2-methylbutane and diepoxypropylamine.

To prepare the pretreatment agents to be used according to the invention, the polyethyleneimine and the bifunctional alkylating agent are reacted with each other in a weight ratio of 100:0.01 to 100:2.0, preferably 100:0.1 to 100:1.0.

It is likely that, in this reaction, crosslinking bridge members become incorporated between the polyethyleneimine chains. An outward sign of this is that the viscosity of the aqueous solution substantially increases as uncrosslinked polyethyleneimine turns into a product crosslinked by the bifunctional alkylating agent. The reaction of the polyethyleneimine with the bifunctional alkylating agent can, in principle, be carried out without solvent. However, for better control over the reaction and more efficient heat dissipation, it is advantageous to carry out the reaction in the presence of an inert solvent. Solvents which come into consideration for this purpose include not only organic solvents in which the reactants are soluble, for example lower alcohols, but also in particular water. The reaction can be carried out within the temperature range from −10° to about 100° C. It is particularly advantageous to carry out the reaction in the vicinity of standard room temperature, i.e. within the range from 15° to 45° C. The result is a reaction allowing efficient control, giving very good product quality and having minimum possible energy requirements. The reaction, if performed in this manner, is substantially complete in about 1 to 2 hours.

To obtain assistants to be used according to the invention which have particularly close specifications; that is, to obtain particularly good reproducibility for the process of preparation, it is advantageous after the main reaction has take place to stir the reaction mixture for several hours, in general 2 to 6 hours, at a defined pH between 9 and 10 and at elevated temperatures, advantageously between 60° and 100° C.

The reaction products of polyethyleneimine with a bi-functional alkylating agent which are used according to the invention can, if desired, also be quaternized with $C_1$–$C_4$-alkyl, preferably $C_1$–$C_3$-alkyl, groups. The quaternization can be carried out with alkyl halides, preferably alkyl chlorides, or dialkyl sulfates in a conventional manner.

This previously disclosed assistant is applied together with a wetting or padding assistant customary in the textile industry from an aqueous liquor to the textile material to be dyed or printed. Suitability for use as such wetting or padding assistants is possessed by alkane-sulfonates, dialkyl sulfosuccinates, dialkyl phosphates or propylene oxide/ethylene oxide block polymers having an ethylene oxide content of 40–80% by weight, but in particular nonionic compounds, for example ethoxylated nonylphenol. The textile material to be treated comprises gray-state or pretreated cotton or cotton-containing blend fabrics. The process according to the invention is of particular interest for the pretreatment of cotton warp yarns with the assistant described in the size. Weaving with untreated weft yarns and subsequent alkali-free cross-dyeing with reactive dyes then leaves a denim effect on the washed-off fabric.

The pretreatment with the assistant together with a nonionic wetting agent takes place from an aqueous liquor in a conventional manner by padding or by the exhaust method at temperatures from about 20° to 70° C., preferably 40° to 60° C., in the size from 80° C. to the boil. The liquor is adjusted to a weakly acidic pH, preferably pH 6. The amount of assistant is about 3 to 10%, preferably 3 to 8%, based on the weight of fiber. The amount of wetting agent is preferably 2 to 4 g/l. The pretreatment liquor is subsequently squeezed off, and the textile material is dried.

The material thus pretreated is then dyed with reactive dyes in a conventional manner and in conventional dyeing apparatus, for example by the cold pad-batch method or by an exhaust method. The liquor ratio for the dyeing can range from about 3:1 to 40:1. However, the important point here is that, in contradistinction from the procedure hitherto customary, no alkali is used in the present case. Suitable reactive dyes for this process are all known types of reactive dyes which contain groups which are reactive toward the hydroxyl groups on the cellulose and which, under the dyeing conditions described according to the invention, react, preferably by reaction, with the polymers fixed on the cellulose material. The reactive groups are for example groups having easily detachable substituents which leave behind an electrophilic residue, such as reactive groups of the vinyl sulfone type, halogen-substituted groups of the ring systems quinoxaline, phthalazine, triazine, pyrimidine or pyridazone, or alkylsulfonyl-substituted reactive groups in the case of sulfonylpyrimidine or sulfonylbenzothiazole dyes. Specific examples are dyes having reactive groups comprising β-sulfatoethyl sulfone, β-chloroethyl sulfone, β-thiosulfatoethyl sulfone, β-phosphatoethyl sulfone, chlorotriazinylamino, dichlorotriazinylamino, chlorotriazinyldiamino, trichloropyrimidylamino, dichloropyrimidylamino, dichloropyridazinylamino, trichloropyridazinylamino, dichloropyridazinylcarbonylamino, 2-chlorobenzothiazol-6-ylamino, 2-methylsulfonylbenzothiazol-6-ylamino, 2,3-dichloroquinoxalin-6-ylcarbonylamino or 4-chloro-5-methyl-2-methylsulfonylpyrimid-3-ylamino.

Suitable dye parent structures for the reactive dyes are for example water-soluble azo, disazo, formazan, anthraquinone, dioxazine or phthalocyanine dyes. Preference is given to water-soluble azo and disazo reactive dyes which can also be metal complex reactive dyes. After dyeing, the materials are completed by rinsing, possibly soaping and drying.

The process according to the invention can be carried out not only with reactive dyes, but in the same way also with other types of dyes which contain anionic, for example sulfo, groups, such as, for example, direct dyes, acid dyes and water-soluble sulfur dyes. Using these dyes, similar effects and fastness properties are obtained as with reactive dyes. In addition, it is also possible to use in the process pigment dyes, such as vat and sulfur dyes.

The process according to the invention is suitable not only for dyeing textile material but also for printing. This comprises printing the textile material with a print paste which contains a sighting dye and the assistant to be used according to the invention. After drying and fixing, the textile material is then cross-dyed with reactive dyes without alkali, preferably by the pad-steam method or by the exhaust method. In another technique, the cotton warp yarns or fabrics which have been premordanted with the assistant described are printed with a print paste which contains the reactive dye but no alkali, and subsequently the dyeing is fixed, for example by steaming at 102°–105° C. for 8 minutes. The subsequent aftertreatment is then carried out as for dyeing.

The essential advantage of the process according to the invention is that, as a consequence of the pretreatment with the assistant described, no alkali is required in the subsequent dyeing. Hence there will also be no alkali passing into the effluent during the final wash of the textile material after dyeing, so that the level of salt in dyehouse effluent is substantially reduced.

In addition, the pretreatment described in some instances also brings about a substantial deepening in the depth of shade compared with a dyeing with the same amount of reactive dye in a conventional dyeing process. One alkali which is widely used, inter alia, for fixing reactive dyes is waterglass. If this waterglass is not carefully washed off after fixing, the result can be unwelcome $SiO_2$ deposits on the textile material and hence hand impairment. This disadvantage too disappears in the process according to the invention. This novel process, by virtue of requiring no alkali, also facilitates the washoff of unfixed dye portions, since, in the presence of alkali, the cotton fiber swells and the unfixed dye is absorbed more strongly. This does not occur in the process according to the invention.

Reactive dye solubility, which is greatly limited by alkali, is substantially improved, and the stability of the neutral dyeing liquors is increased.

The dyeings produced using the process according to the invention described above show good wet fastness properties.

It has now been found, surprisingly, that if soaping is immediately followed by washing with perborate-containing washing agents, the brilliance of the dyeings is substantially enhanced and the undyed or, depending on the hue of the dye, slightly stained weft thread turns out white, so that the dyeing obtained is of high brilliance and has a white weft yarn. The use of optical brighteners in the washing liquor further increases the brilliance of the dyeings and of the weft yarns.

These effects are achieved in particular when the wash is carried out at 20°–50° C., preferably at 40°–50° C. If the wash with the perborate-containing washing agent is carried out at higher temperatures, for example 50° to 100° C., preferably 85° to 100° C., the denim dyeing can be lightened in stages until the fabric is virtually completely colorless. In this way, unlevel dyeings and/or fashionable variations in shade in the nature of a stonewash effect are obtained in a very gentle manner for the fibers. This effect is otherwise only obtainable with alkaline hypochlorite solutions and possibly by washing in the presence of pumice stones.

The amount of alkali perborate in the washing agents ranges from about 4 to 25% by weight. These perborate-containing washing agents in question here are described in detail in "Tenside" 18, p. 246 (1981). In what follows, two formulations to this end are described in more detail by way of examples:

| | | |
|---|---|---|
| 1. | anionic/nonionic surfactants | 10–25% |
| | soaps (alkali metal salts of fatty acids) | 0–10% |
| | polyphosphates | 20–50% |
| | sodium perborate or potassium perborate | 10–25% |
| | Na silicate | 3–10% |
| | carboxymethylcellulose | 1–2% |
| | neutral salts and standardizing agents | 5–20% |
| | optical brighteners | 1–2% |
| 2. | soap | 35–50% |
| | tetrapropylenebenzenesulfonate | |
| | fatty alcohol sulfate | |
| | fatty acid ethanolamide | |
| | Na carbonate | 14–18% |
| | Na waterglass | 6–10% |
| | Na diphosphate | 5–8% |
| | Na triphosphate | |
| | Na perborate | 4–6% |
| | magnesium silicate | 1–3% |
| | optical brighteners | 0.03% |
| | carboxymethylcellulose | |
| | scent oil | |

EXAMPLE 1

Cotton warp yarns are treated as follows in the size box of a sizing machine:

40 g/l of polyvinyl alcohol (PVA)
5 g/l of polyethylene glycol
4 g/l of potassium di-2-ethylhexyl phosphate
100 g/l of polyethyleneimine condensation product as per the example in Table 1, last line of Patent Application EP 0,133,933

Liquor pickup 100–120% (high-performance squeeze rollers).

The yarn runs at a speed of 60 m/min, and the liquor temperature is 80°–90° C. On leaving the size box, the cotton warp yarns are dried at about 130° C. with contact heat.

In place of PVA it is also possible to use modified starch or mixtures of modified starch and PVA. The use of carboxymethylcellulose or carboxymethyl starch as sizing agent is not possible, since precipitates can form here with the cationic alkali metal ethylene in the condensate.

The cotton warp yarns are then woven up with the cotton weft, and the fabric obtained is overpadded on a cold pad-batch unit comprising a pad mangle and a batchup apparatus with a solution containing for example 10 g/l of C.I. Reactive Blue 19 (C.I. No. 61,200) and 4 g/l of wetting agent (ethoxylated nonylphenol).

The fabric thus padded is provided on the beam with an airtight wrapping with polyethylene sheeting and is left to rotate for up to 24 hours.

The customary aftertreatment for the reactive dyes of rinsing, soaping at the boil and further rinsing gives, even without the alkali normally necessary for fixing the reactive dyes, a dyeing on the warp yarns which has good end-use fastness properties. The pretreatment of these cotton warp yarns with the polyethyleneimine condensation product, in addition, produces a substantially deeper shade than normal fixing with alkali. The weft becomes virtually white again in the course of the aftertreatment of rinsing and soaping. In this way a denim effect fabric is obtained.

EXAMPLE 2

The denim fabric sized and dyed as under Example 1 is treated, after the final rinsing and soaping process, with 5 g/l of a customary perborate-containing washing agent (Na perborate content 20% by weight) at 50°–60° C. for 10 to 20 minutes.

This produces a substantially more brilliant hue on this denim fabric while preserving the full strength and intensity of the dyeing. In addition, the white of the weft yarn is once more substantially improved compared with a denim fabric which had been dyed in the same manner but which had not been afterwashed with a perborate-containing washing agent.

EXAMPLE 3

Bleached cotton twill is treated in a liquor ratio of 40:1 with 4% of the polyethyleneimine condensation product specified in Example 1 and 1 g/l of di-2-ethoxylated nonylphenol, as follows: starting cold, the temperature is raised at a uniform rate to 40°–50° C. in the course of 20 minutes, and treatment is continued at that temperature for 10 minutes.

The liquor is then dropped, and the cotton twill is squeezed off and cross-dyed with a liquor which contains only 1% by weight of Reactive Blue 77.

The liquor ratio is 30:1. The dyeing is started cold, the temperature is then raised at a uniform rate to 60° C. in the course of 30 minutes, and dyeing is continued at 60° C. for a further hour.

The customary aftertreatment of rinsing, soaping and rinsing here too produces a deep greenish blue shade which is substantially deeper than a corresponding exhaust dyeing carried out with 1% of dye, 50 g/l of sodium chloride or Glauber salt, 3 ml/l of 38° Bé NaOH and 5 g/l of calcined sodium carbonate.

EXAMPLE 4

A bleached cotton fabric is overpadded cold on a 2- or 3-roll padder with a solution which contains 60 g/l of the polyethyleneimine condensation product as in Example 1 and
2 g/l of potassium 2-ethylhexyl phosphate and after drying is padded with a liquor which contains 10 g/l of Reactive Red 1 (C.I. No. 18,158) and
2 g/l of a wetting agent (ethoxylated nonylphenol).

The dyeing is batched and aftertreated as in Example 1. The result obtained is a deep red dyeing having good end-use fastness properties. By comparison, the corresponding cold pad-batch dyeing performed with the normal amount of alkali (NaOH/waterglass) is only pink in color. The addition of about 10 g/l of an aqueous dispersion containing 3.5% of acrylamide homopolymer and 4.5% of caprolactam as padding assistant to the padding liquor additionally produces once more a substantial liquor pickup.

EXAMPLE 5

The sized denim fabric as described in Example 1 is overpadded on a cold pad-batch unit comprising a pad mangle and a batchup apparatus with a solution containing 25 g/l of C.I. Solubilized Sulphur Red 11 and
4 g/l of wetting agent (ethoxylated nonylphenol).

The fabric thus padded is provided on the beam with an airtight wrapping with polyethylene sheeting and is left to rotate for up to 24 hours.

The customary aftertreatment of rinsing, soaping at the boil and further rinsing gives, even without the alkali and reduction agents (for example $Na_2S$ on NaSH) normally necessary for fixing the sulfur dyes, a dyeing on the yarn which has good enduse fastness properties and a good fastness to light.

We claim:

1. A process for alkali-free dyeing and printing with reactive dyes direct dyes, acid dyes, water-soluble-sulfur dyes or pigment dyes, which comprises pretreating the cellulose textile material to be dyed with a wetting agent and a quaternized or unquaternized reaction product of polyethyleneimine with a bifunctional alkylating agent, then dyeing with reactive dyes, direct dyes, acid dyes, water-soluble sulfur dyes or pigment dyes in a conventional manner but without the use of alkali, and finishing by rinsing and drying.

2. The process as claimed in claim 1, wherein warp yarn is pretreated with a wetting agent and a reaction product of polyethyleneimine with a bifunctional alkylating agent in a size bath together with the size.

3. The process as claimed in claim 1, wherein the reaction product is preferably used in an amount of 3 to 10% on weight of fiber.

4. The process as claimed in claim 1, wherein a reaction product of polyethyleneimine with epichlorohydrin, 1,3-dichloropropan-2-ol or mixtures thereof is used.

5. The process as claimed in claim 1, wherein a reaction product of polyethyleneimine with a bifunctional alkylating agent in a reactant weight ratio of 100:0.1 to 100:2 is used.

6. The process as claimed in claim 1, wherein a polymeric padding assistant is added to the dye-pad liquor.

7. The process as claimed in claim 1, wherein the dyeings or prints are subsequently washed with a washing agent which contains a perborate with or without a perborate activator and optical brighteners.

* * * * *